US006481245B1

(12) United States Patent
Kalde

(10) Patent No.: US 6,481,245 B1
(45) Date of Patent: Nov. 19, 2002

(54) SOCK WITH ASYMMETRICAL TOE AND METHOD OF PRODUCING SUCH A SOCK

(75) Inventor: Franz-Josef Kalde, Schmallenberg (DE)

(73) Assignee: Falke KG, Schmallenberg (DE)

( * ) Notice: Subject to any disclaimer, the term of this patent is extended or adjusted under 35 U.S.C. 154(b) by 0 days.

(21) Appl. No.: 09/619,974

(22) Filed: Jul. 20, 2000

Related U.S. Application Data

(63) Continuation-in-part of application No. PCT/EP99/00338, filed on Jan. 20, 1999.

(51) Int. Cl.[7] ..... D04B 11/34
(52) U.S. Cl. ..... 66/178 R
(58) Field of Search ..... 66/178 R, 180, 66/184, 185, 186, 187; 2/239, 240, 241

(56) References Cited

U.S. PATENT DOCUMENTS

| | | | | | |
|---|---|---|---|---|---|
| 369,637 | A | * | 9/1887 | Folsom | 66/187 |
| 1,160,819 | A | * | 11/1915 | Barr | 66/187 |
| 1,314,356 | A | * | 8/1919 | Nordblad | 66/187 |
| 1,452,302 | A | * | 4/1923 | Loven | 66/187 |
| 1,726,441 | A | * | 8/1929 | Loven | 66/187 |
| 2,144,563 | A | | 1/1939 | Davis | |
| 3,217,336 | A | | 11/1965 | Wikler | |

FOREIGN PATENT DOCUMENTS

| | | |
|---|---|---|
| CH | 197 252 | 7/1938 |
| GB | 2 184 750 A | 7/1987 |

* cited by examiner

*Primary Examiner*—Danny Worrell
(74) *Attorney, Agent, or Firm*—Laurence A. Greenberg; Werner H. Stemer; Gregory L. Mayback

(57) ABSTRACT

A sock with an asymmetrical toe includes a toe region having an edge which substantially matches the shape of the toes to increase comfort for the wearer of a knitted sock. A substantial part of the toe region is knitted all the way through. A method of producing such a sock is also provided.

4 Claims, 3 Drawing Sheets

SOCK WITH ASYMMETRICAL TOE AND METHOD OF PRODUCING SUCH A SOCK

CROSS-REFERENCE TO RELATED APPLICATION

This application is a continuation of copending International Application No. PCT/EP99/00338, filed Jan. 20, 1999, which designated the United States.

BACKGROUND OF THE INVENTION

Field of the Invention

The invention relates to a knitted sock with a toe region having an edge which substantially follows a toe profile. The invention also relates to a method for producing a knitted sock.

Such a sock structure is known, for example, from U.S. Pat. No. 3,217,336. That patent discloses a toe region of the knitted sock which is shaped essentially in such a way that, when worn, the toe region follows the toe profile. It is correspondingly possible to differentiate between a sock for a right foot and a sock for a left foot.

Although the proposal according to U.S. Pat. No. 3,217,336 has been known for some time now, such socks have not been commercially successful. It is known from U.S. Pat. No. 3,217,336 that the toe region is knitted in such a way that seams are provided in the toe region of the sock which make such a sock considerably less comfortable to wear.

SUMMARY OF THE INVENTION

It is accordingly an object of the invention to provide a knitted sock with an asymmetrical toe region having an edge which essentially follows a toe profile, so that the sock is more comfortable to wear, and a method of knitting a sock with an edge which essentially follows a toe profile, which overcome the hereinafore-mentioned disadvantages of the heretofore-known devices and methods of this general type.

With the foregoing and other objects in view there is provided, in accordance with the invention, a knitted sock, comprising a toe region having an edge substantially following a toe profile, the toe region knitted substantially continuously, and the toe region padded by at least one further thread.

By virtue of this configuration of the knitted sock according to the invention, better wearing comfort is achieved in the toe region since there are no aggravating seams present in this toe region.

In particular, seams which could butt against the big toe and/or the little toe are dispensed with. Such seams are regarded as particularly aggravating if the foot which is wearing the knitted sock is enclosed in an item of footwear that is closed in the toe region, since the item of footwear, which is close-fitting, presses the seam against the big toe and/or the little toe.

It should be pointed out in this case that the term sock is also intended to cover stockings. A sock in the context of the invention is any item of clothing for the foot which is knitted and has a toe region.

In accordance with another feature of the invention, the toe region has an essentially trapezoidal construction. The trapezoidally constructed toe region is preferably configured in such a way that those edges of the toe region which are inclined toward one another are inclined at different angles in relation to a common base. In this case, the edge region which is adjacent the big toe when the sock is being worn is preferably inclined to a lesser extent than the opposite edge region.

In accordance with a further feature of the invention, in order to provide a further increase in the wearing comfort of the sock, the toe region is knitted by using a core thread and at least one further thread. Padding of the toe region is achieved by the at least one additional thread.

In accordance with an added feature of the invention, the at least one further thread is knitted by using a higher loop density than the core thread. The sock as such preferably has a continuous core thread. The higher loop density of the at least one further thread achieves padding of the toe region by straightforward measures.

The knitted sock is constructed in the toe region in such a way that it essentially follows the outer contour of the toes. Accordingly, differently contoured socks are necessary for a left foot and for a right foot.

In accordance with an additional feature of the invention, in order to make it easier to differentiate between a left sock and a right sock, the sock has at least one visual and/or haptic marking. The marking is preferably knitted in.

With the objects of the invention in view, there is also provided a method of producing a knitted sock, which comprises circularly knitting a cylindrical section having a toe region with an edge substantially following a toe profile, by reducing a number of stitches, at least on one side, to a central region, and then increasing the number of stitches, at least on one side, from the central region; and knitting at least one further thread into the toe region to form padding.

Accordingly, a knitted sock is produced with a toe region having an edge that essentially follows a toe profile, the toe region is knitted in an essentially continuous manner and the sock is knitted, in particular, on a circular knitting machine. Initially, a cylindrical section is formed by circular knitting. The cylindrical section is adjoined by the toe region having the edge which essentially follows the toe profile. The toe region is formed in such a way that the number of stitches of the individual rows of stitches are reduced, at least on one side, to a central region. The number of stitches of the following rows of stitches are then increased at least on one side. The toe region that is formed in this way is then sewn together.

In accordance with another mode of the invention, the number of stitches is reduced uniformly in each row of stitches. The widening, as a result of the increase in the number of stitches, advantageously takes place on both sides, in each case with two needles, to the end of the toe region.

In accordance with a further mode of the invention, two rows of stitches are narrowed on both sides. Preferably the first two rows of stitches are narrowed. The rows of stitches are followed by a row of stitches for which at least two needles are activated on one side through the use of a double picker, with the result that the number of stitches is increased. The rows of stitches are followed by two rows of stitches which are narrowed on both sides. The reduction and the increase in the number of stitches in the individual rows of stitches is repeated alternately to a central region. The widening takes place conversely. After every third row, the double picker is disengaged on one side, optionally on the right or left. A standard row is preferably knitted in the central region.

In accordance with an added mode of the invention, in a first step, in one row of stitches, optionally at one edge, one needle is activated through the use of a modified side picker. In a further step, there is formed, following the row of stitches, a row of stitches which is narrowed on both sides through the use of the side picker. The individual steps are repeated alternately to the central region. Then there is an increase in the number of stitches, wherein after every second row, the double picker brings one needle into operation optionally at one edge or the other.

In the preferred method, two needles are brought out of operation on both sides through the use of a modified side picker. In each case one needle is brought into operation on both sides, to the central region, by a modified double picker. After the central region, the side pickers are deactivated. In the following rows, in each case one needle is brought into operation on both sides.

In accordance with a concomitant mode of the invention, two needles are brought out of operation on both sides through the use of a side picker. One needle is brought into operation at one edge through the use of a double picker, wherein from the central region, the side picker is deactivated and, in the following rows of stitches, at least one needle is brought into operation at one edge.

Other features which are considered as characteristic for the invention are set forth in the appended claims.

Although the invention is illustrated and described herein as embodied in a sock with an asymmetrical toe and a method of producing such a sock, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
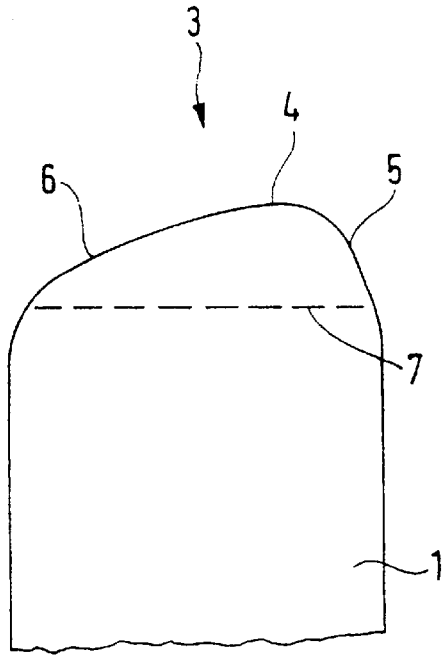
FIG. 1 is a fragmentary, diagrammatic, plan view of part of a left sock.

Referring now to the figures of the drawings in detail and first, particularly, to FIG. 1 thereof, there is seen a diagrammatic, plan view of part of a left sock 1. The sock 1 has a toe region 3.

The sock 1 is knitted and the toe region 3 is knitted in a continuous manner. The toe region 3 has an edge 4 with a profile that essentially corresponds to a toe profile. In the illustrated exemplary embodiment, the toe region 3 has an essentially trapezoidal structure. The toe region 3 has an edge section 5 which butts against the big toe of the left foot when the sock is being worn. An inclination of the edge section 5 is smaller than an inclination of an opposite edge section 6, relative to an imaginary common base 7 illustrated by dashed lines. The edge 4 is seam-free, as a result of which it is not possible for any seam-induced pressure points to be produced in the toe region when the sock is being worn. That makes this sock considerably more comfortable to wear than conventional socks.

Figure 2:
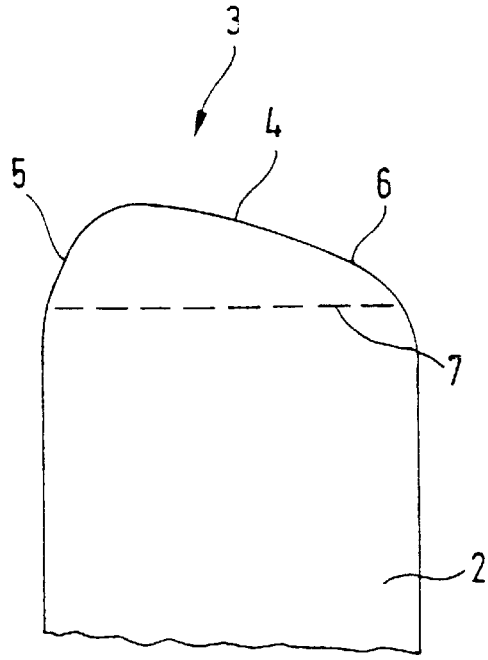
FIG. 2 is a fragmentary, plan view of part of a right sock.

FIG. 2 shows a plan view of an example of a configuration of a right sock. The configuration of the right sock 2 in FIG. 2 corresponds essentially to the configuration of the left sock 1 according to FIG. 1.

Figure 3:
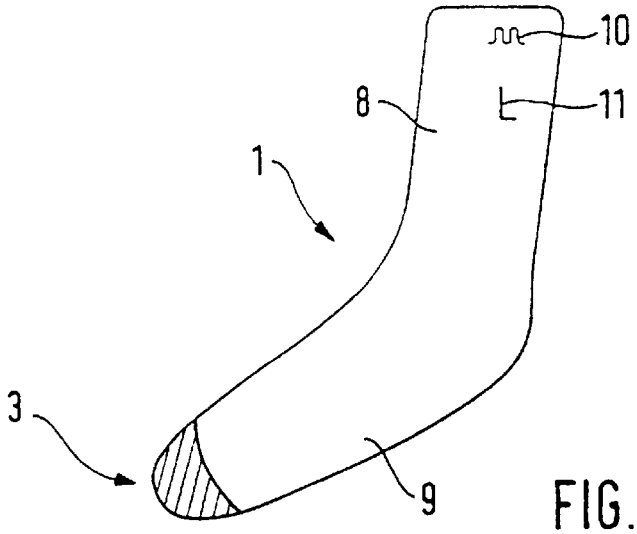
FIG. 3 is a plan view of a left sock on a reduced scale.

FIG. 3 diagrammatically shows a left sock. The sock 1 has a leg 8 which is adjoined by a foot part 9 with the toe region 3. The sock is knitted by using a core thread 10. At least one further thread is knitted into the toe region 3, as a result of which the toe region 3 is padded. Additional padding of the sock 1 may be provided. In particular, the padding may be formed in such a way that it corresponds to the anatomical profile of a foot.

FIG. 3 also shows that the leg 8 is provided with a marking 11, which is knitted into the leg 8.

Figure 4:
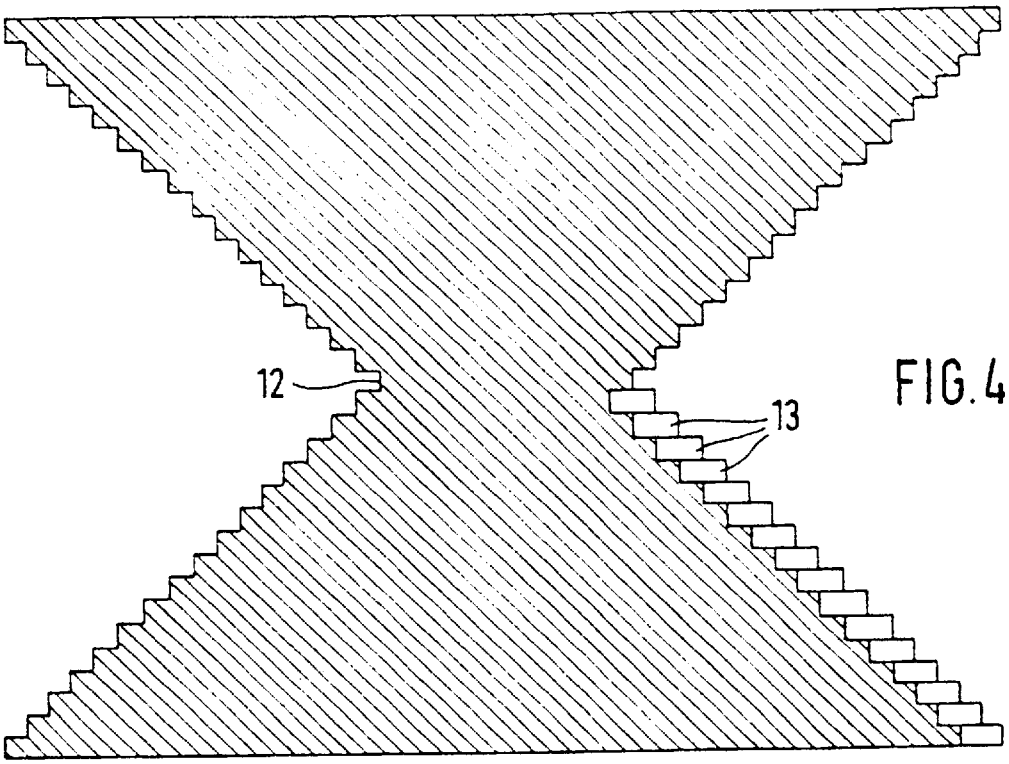
FIGS. 4 to 8 are projected developments illustrating a formation of a toe region.

FIG. 4 shows a projected development of a toe region in plan view. The sock is knitted on a so-called circular knitting machine. First of all a non-illustrated cylindrical section is formed by circular knitting. The toe region 3 is formed by narrowing, needle by needle, on both sides, through the use of a side picker, to a central region 12. Thereafter, additional double pickers are engaged on both sides. In the illustrated exemplary embodiment, the widening takes place through the use of two needles. The widening is indicated in FIG. 4 by a designation 13. The different narrowing and widening form a toe region which essentially follows a toe profile.

Figure 5:
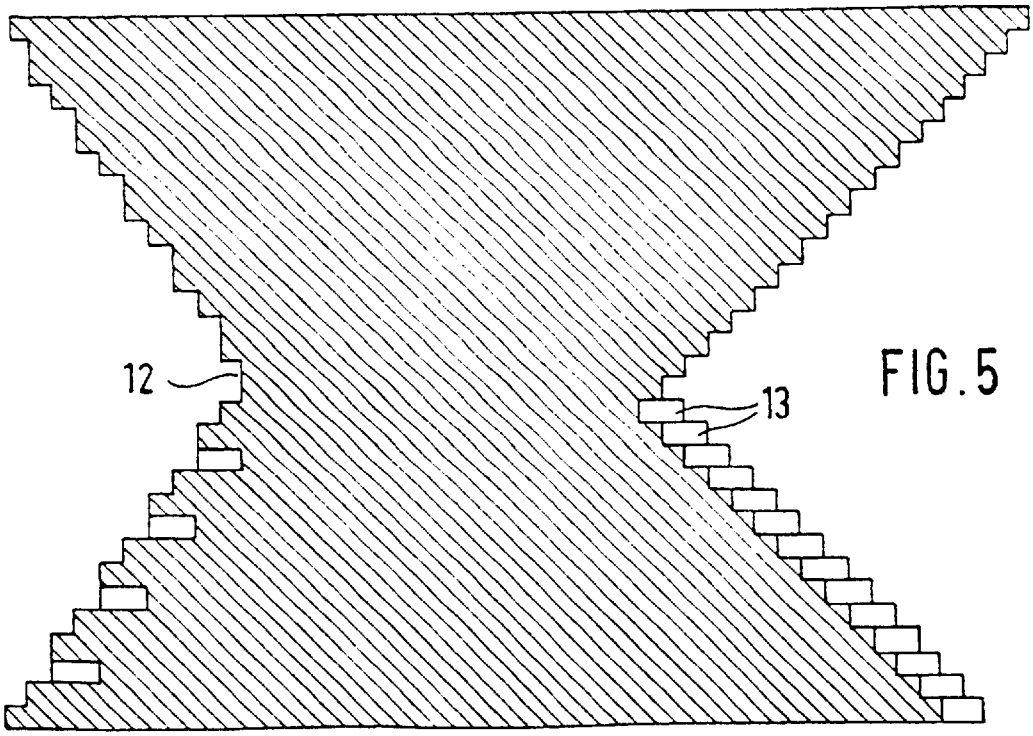

A second possible way of forming the toe region is indicated in FIG. 5. The first two rows are narrowed on both sides through the use of a side picker. Additional needles, preferably two needles, are activated in the third row of stitches. FIG. 5 shows that the left-hand needles are activated. This operation is repeated to the third-to-last row before the central region 12. After a standard row, in the last row of the central region of the toe, two needles are activated again on one side, optionally on the right or left. The widening takes place conversely. After every third row of stitches, the double picker is disengaged on one side, optionally on the right or left.

Figure 6:
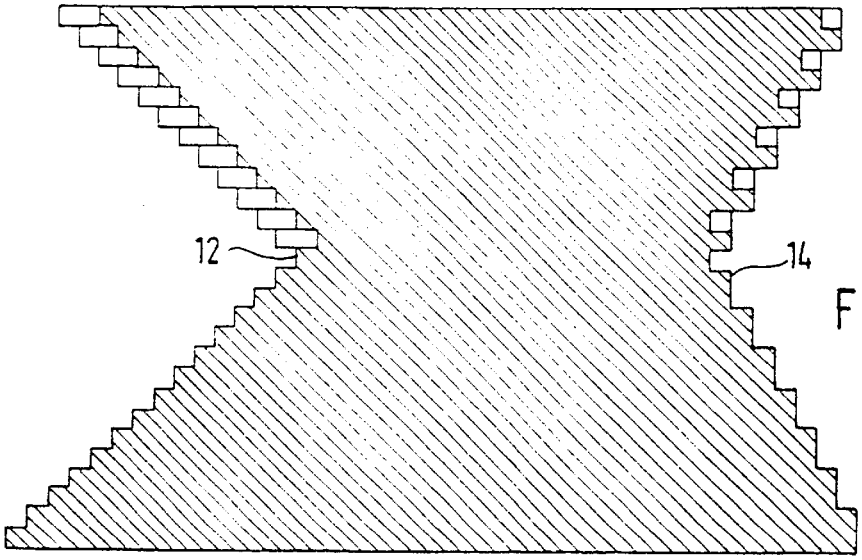

FIG. 6 shows a further projected development of a toe region. The first row of the toe region is narrowed on both sides through the use of side pickers. In the second row of stitches, one needle is additionally activated through the use of a double picker, optionally on the right or left. In the illustrated exemplary embodiment, one needle is activated on the right-hand side. This operation is repeated to the penultimate row of the central region 12. Thereafter, one needle is activated at reference numeral 14 on the right or left. The increase in the number of stitches takes place conversely. After every second row of stitches, the double picker brings one needle into operation. Optionally the right-hand or left-hand needle can be engaged. The opposite side of the narrowing continues. The double picker brings two needles into operation there, as can be seen in the right-hand part of FIG. 6.

Figure 7:
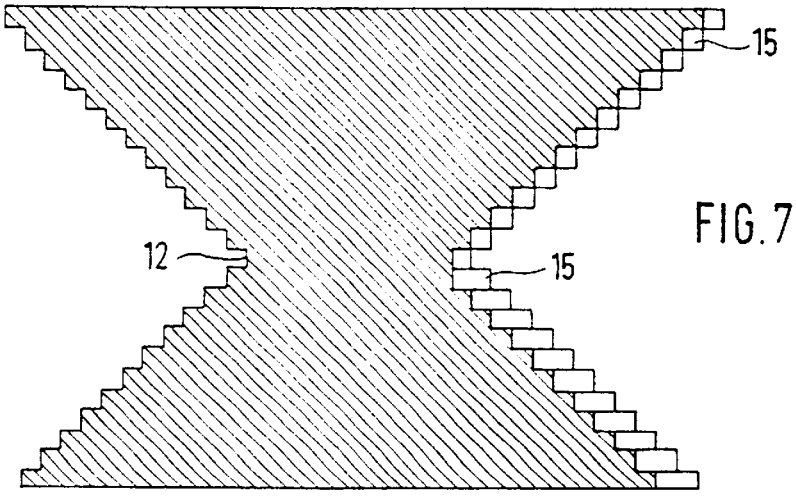

Yet another possible way of producing a sock is explained hereinbelow with reference to a projected development of the toe region which is illustrated in FIG. 7. Reference numeral 12 designates a central row region of the toe region, around which the opposite regions are folded.

Two needles are brought out of operation on both sides through the use of a side picker. In each case one needle is brought into operation on both sides, to the central region 12, by a modified double picker, as is indicated at reference numeral 15. After the central region, the side pickers are deactivated. In the following rows of stitches of the toe region, in each case one needle is brought into operation on both sides.

Figure 8:
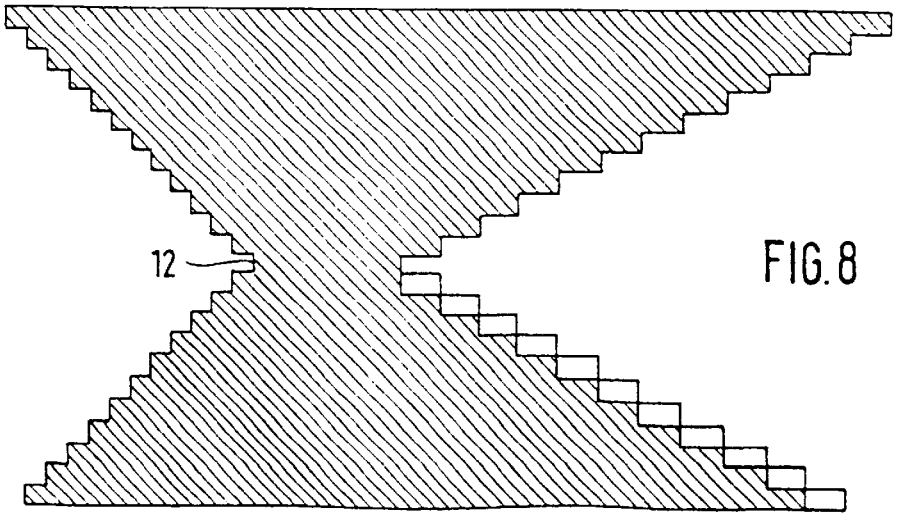

FIG. 8 shows yet another possible way of forming a toe region. The illustration shows the toe region as a projected development. Two needles are brought out of operation on both sides through the use of a modified side picker. One needle is brought into operation by a double picker. The individual rows of stitches are knitted to the central region 12. After the central region, the side pickers are deactivated. In the following rows of stitches, two needles are brought into operation optionally on the right or left. This results in the edges sloping differently to the central region 12.

I claim:

1. A method of producing a knitted sock, which comprises:

circularly knitting a cylindrical section having a toe region with an edge substantially following a toe profile, by reducing a number of stitches, at least on one side, to a central region, and then increasing the number of stitches, at least on one side, from the central region;

knitting at least one further thread into the toe region to form padding; and producing a widening to an end of the toe region, as a result of the increase in the number of stitches, with two needles on each of two sides.

2. A method of producing a knitted sock, which comprises:

circularly knitting a cylindrical section having a toe region with an edge substantially following a toe profile, by reducing a number of stitches, at least on one side, to a central region, and then increasing the number of stitches, at least on one side, from the central region;

knitting at least one further thread into the toe region to form padding; and narrowing two rows of stitches on both sides, additionally activating at least two needles on one side with double pickers in a following row of stitches, narrowing two rows of stitches on both sides following the row of stitches, repeating the procedure to the central region, and carrying out a widening conversely.

3. A method of producing a knitted sock, which comprises:

circularly knitting a cylindrical section having a toe region with an edge substantially following a toe profile, by reducing a number of stitches, at least on one side, to a central region, and then increasing the number of stitches, at least on one side, from the central region;

knitting at least one further thread into the toe region to form padding; and a) activating one needle with modified side pickers in one given row of stitches, optionally at one edge;

b) narrowing a row of stitches following the given row of stitches on both sides with side pickers;

alternating step a) and step b) to the central region; and then increasing the number of stitches by activating one needle optionally at one edge or the other with the double picker after every second row.

4. A method of producing a knitted sock, which comprises:

circularly knitting a cylindrical section having a toe region with an edge substantially following a toe profile, by reducing a number of stitches, at least on one side, to a central region, and then increasing the number of stitches, at least on one side, from the central region;

knitting at least one further thread into the toe region to form padding; and bringing two needles out of operation on both sides with a side picker, and bringing one needle into operation at one edge with a double picker, deactivating the side picker after the central region, and bringing at least one needle into operation at one edge in following rows of stitches.

* * * * *

UNITED STATES PATENT AND TRADEMARK OFFICE

CERTIFICATE OF CORRECTION

PATENT NO. : 6,481,245 B1
DATED : November 19, 2002
INVENTOR(S) : Franz Josef Kalde It is certified that error appears in the above-identified patent and that said Letters Patent is hereby corrected as shown below:

Title page,
Item [30], should read as follows:

-- Jan. 20, 1998 (DE) …….. 298 00 791.6 --

Signed and Sealed this

Fifteenth Day of April, 2003

JAMES E. ROGAN
*Director of the United States Patent and Trademark Office*